US009353629B2

(12) United States Patent
Faulder

(10) Patent No.: US 9,353,629 B2
(45) Date of Patent: May 31, 2016

(54) TURBINE BLADE APPARATUS

(71) Applicant: Solar Turbines Incorporated, San Diego, CA (US)

(72) Inventor: Leslie John Faulder, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 872 days.

(21) Appl. No.: 13/690,417

(22) Filed: Nov. 30, 2012

(65) Prior Publication Data

US 2014/0150454 A1 Jun. 5, 2014

(51) Int. Cl.
*F01D 5/14* (2006.01)
*F01D 5/22* (2006.01)

(52) U.S. Cl.
CPC . *F01D 5/141* (2013.01); *F01D 5/22* (2013.01); *F05D 2240/80* (2013.01)

(58) Field of Classification Search
CPC ..... F05D 2240/80
USPC ..... 416/193 A, 239, 248
See application file for complete search history.

(56) References Cited

U.S. PATENT DOCUMENTS

| | | | | |
|---|---|---|---|---|
| 4,824,328 | A | 4/1989 | Pisz et al. | |
| 5,261,790 | A | 11/1993 | Dietz et al. | |
| 5,350,277 | A * | 9/1994 | Jacala et al. | 416/90 R |
| 5,435,694 | A | 7/1995 | Kray et al. | |
| 5,791,877 | A | 8/1998 | Stenneler | |
| 6,450,769 | B2 | 9/2002 | Szwedowicz | |
| 6,478,544 | B2 | 11/2002 | Brandl et al. | |
| 6,923,616 | B2 * | 8/2005 | McRae et al. | 415/115 |
| 7,244,101 | B2 * | 7/2007 | Lee et al. | 416/97 R |
| 8,573,942 | B2 * | 11/2013 | Strohl et al. | 416/219 R |
| 8,870,542 | B2 * | 10/2014 | Feldmann et al. | 416/193 A |
| 8,967,974 | B2 * | 3/2015 | Garcia-Crespo | 416/193 A |
| 2004/0184919 | A1 | 9/2004 | Zabawa | |
| 2005/0135936 | A1 | 6/2005 | Cherolis et al. | |
| 2007/0031259 | A1 | 2/2007 | Dube et al. | |
| 2007/0077144 | A1 | 4/2007 | Lee et al. | |
| 2009/0016881 | A1 | 1/2009 | Baldauf et al. | |
| 2009/0123286 | A1 | 5/2009 | Mace et al. | |
| 2010/0111700 | A1 | 5/2010 | Kim et al. | |
| 2010/0232975 | A1 | 9/2010 | Morris et al. | |
| 2012/0093654 | A1 | 4/2012 | Ahmad et al. | |

(Continued)

FOREIGN PATENT DOCUMENTS

| | | | |
|---|---|---|---|
| EP | 1749968 | B1 | 3/2012 |
| GB | 2112466 | A | 7/1983 |

(Continued)

*Primary Examiner* — Ninh H Nguyen
*Assistant Examiner* — Christopher R Legendre
(74) *Attorney, Agent, or Firm* — Finnegan, Henderson, Farabow, Garrett & Dunner, LLP

(57) ABSTRACT

A turbine blade is disclosed. The turbine blade may include a platform, an airfoil extending from one side of the platform, and a neck extending from another side of the platform, wherein the neck includes a forward buttress and an aft buttress. The turbine blade may further include a root extending from the neck, a pocket defined by a plurality of walls and located between the forward buttress and the aft buttress, and a variable radius fillet. The variable radius fillet may be disposed within the pocket and extend between the forward buttress and the aft buttress, wherein a radius of the variable radius fillet increases from the forward buttress to the aft buttress.

20 Claims, 6 Drawing Sheets

(56) References Cited

U.S. PATENT DOCUMENTS

| | | | | |
|---|---|---|---|---|
| 2013/0319008 | A1* | 12/2013 | Faulder et al. | 60/805 |
| 2013/0330189 | A1* | 12/2013 | Garcia-Crespo et al. | 416/61 |
| 2014/0150454 | A1* | 6/2014 | Faulder | 60/805 |

FOREIGN PATENT DOCUMENTS

| | | | | |
|---|---|---|---|---|
| JP | 10131705 | A * | 5/1998 | F01D 5/14 |
| WO | WO 2010/088881 | A1 | 8/2010 | |
| WO | WO 2011/085721 | A2 | 7/2011 | |

* cited by examiner

TURBINE BLADE APPARATUS

TECHNICAL FIELD

The present disclosure is directed to a turbine blade apparatus of a gas turbine engine (GTE) and, more particularly, to a turbine blade apparatus having a variable radius fillet in a pocket of the turbine blade.

BACKGROUND

GTEs produce power by extracting energy from a flow of hot gas produced by combustion of fuel in a stream of compressed air. In general, turbine engines have an upstream air compressor coupled to a downstream turbine with a combustion chamber ("combustor") in between. Energy is released when a mixture of compressed air and fuel is burned in the combustor. The resulting hot gases are directed over blades of the turbine to spin the turbine and produce mechanical power.

Turbine blades and other components of GTEs are subject to high temperatures and high local stresses during operation. Components which undergo these high temperatures and stresses may be subject to mechanical failure, either from component breakage due to a reduced cross section of the component as a result of plastic deformation, or rupture where cracks initiate and propagate until the component is broken. For turbine blades, high local stresses may contribute to platform cracks and failures.

International Publication No. WO 2011/085721 A2 ("the '721 publication") describes a blade of a turbomachine. In particular, the '721 publication discloses a rotor blade of a gas turbine, which has a variable transition radius in the vicinity of at least one platform overhang.

SUMMARY

In one aspect, a turbine blade is disclosed. The turbine blade may include a platform, an airfoil extending from one side of the platform, and a neck extending from another side of the platform, wherein the neck includes a forward buttress and an aft buttress. The turbine blade may further include a root extending from the neck, a pocket defined by a plurality of walls and located between the forward buttress and the aft buttress, and a variable radius fillet. The variable radius fillet may be disposed within the pocket and extend between the forward buttress and the aft buttress, wherein a radius of the variable radius fillet increases from the forward buttress to the aft buttress.

In another aspect, a gas turbine engine is disclosed. The gas turbine engine may include a compressor system configured to compress a flow of air, a combustor system configured to combust a mixture of the air and a fuel to produce a hot gas flow, and a turbine system configured to use the hot gas flow to produce power. The turbine system may include a plurality of turbine blades including a platform, an airfoil extending from one side of the platform, and a neck extending from another side of the platform, wherein the neck includes a forward buttress and an aft buttress. The turbine blade may further include a root extending from the neck, a pocket defined by a plurality of walls and located between the forward buttress and the aft buttress, and a variable radius fillet. The variable radius fillet may be disposed within the pocket and extend between the forward buttress and the aft buttress, wherein a radius of the variable radius fillet increases from the forward buttress to the aft buttress.

In yet another aspect, a turbine blade is disclosed and may include a platform, an airfoil extending from one side of the platform, and a neck extending from another side of the platform, wherein the neck includes a forward buttress and an aft buttress. The turbine blade may further include a root extending from the neck, a pocket defined by a plurality of walls and located between the forward buttress and the aft buttress, and a variable radius fillet formed of a material and disposed within the pocket. The variable radius fillet may extend between the forward buttress and the aft buttress, and an amount of the material forming the variable radius fillet may be greater adjacent the aft buttress than adjacent the forward buttress.

DETAILED DESCRIPTION

Figure 1:
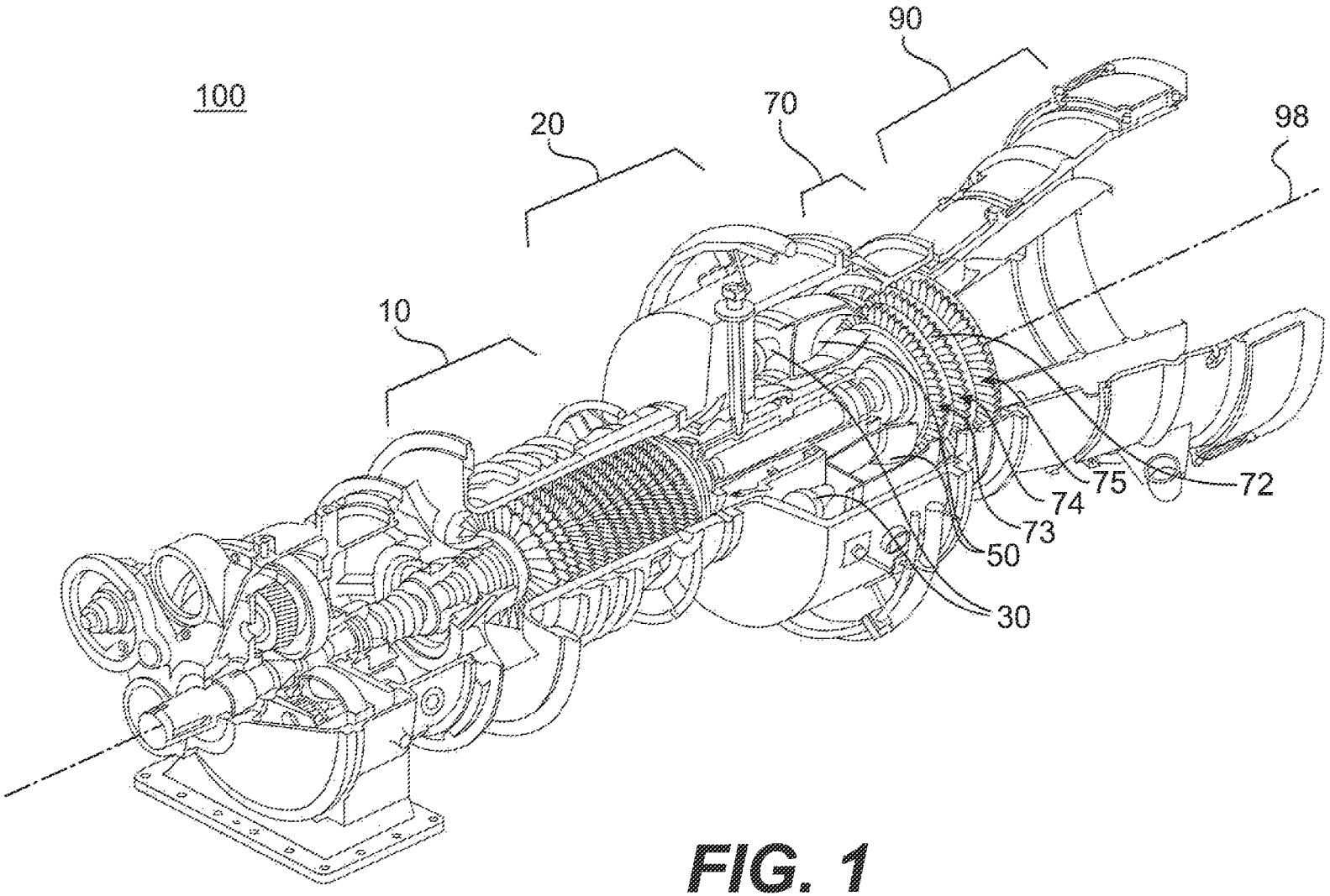
FIG. 1 is an illustration of an exemplary disclosed GTE.

FIG. 1 illustrates an exemplary GTE 100. GTE 100 may have, among other systems, a compressor system 10, a combustor system 20, a turbine system 70, and an exhaust system 90 arranged along an engine axis 98. Compressor system 10 compresses air and delivers the compressed air to an enclosure of combustor system 20. The compressed air is then directed from the enclosure into a combustor 50. Liquid or gaseous fuel may be directed into the combustor 50 through the fuel injectors 30. The fuel burns in combustor 50 to produce combustion gases at high pressure and temperature. These combustion gases are used in the turbine system 70 to produce mechanical power. The turbine system 70 may further include a plurality of turbine blades 72 as part of a series of turbine rotors. Additionally, the turbine system 70 can include a plurality of turbine nozzles as part of a series of turbine stators (not shown). The turbine blades 72, rotors, nozzles, and stators can be included in a series of turbine stages, for example, a first stage 73, a second stage 74, and a third stage 75. Although only three stages 73, 74, 75 are illustrated in FIG. 1, more or less turbine stages may make up part of the turbine system 70. In operation, the turbine system 70 extracts energy from the combustion gases and directs the exhaust gases through exhaust system 90.

Figure 2:
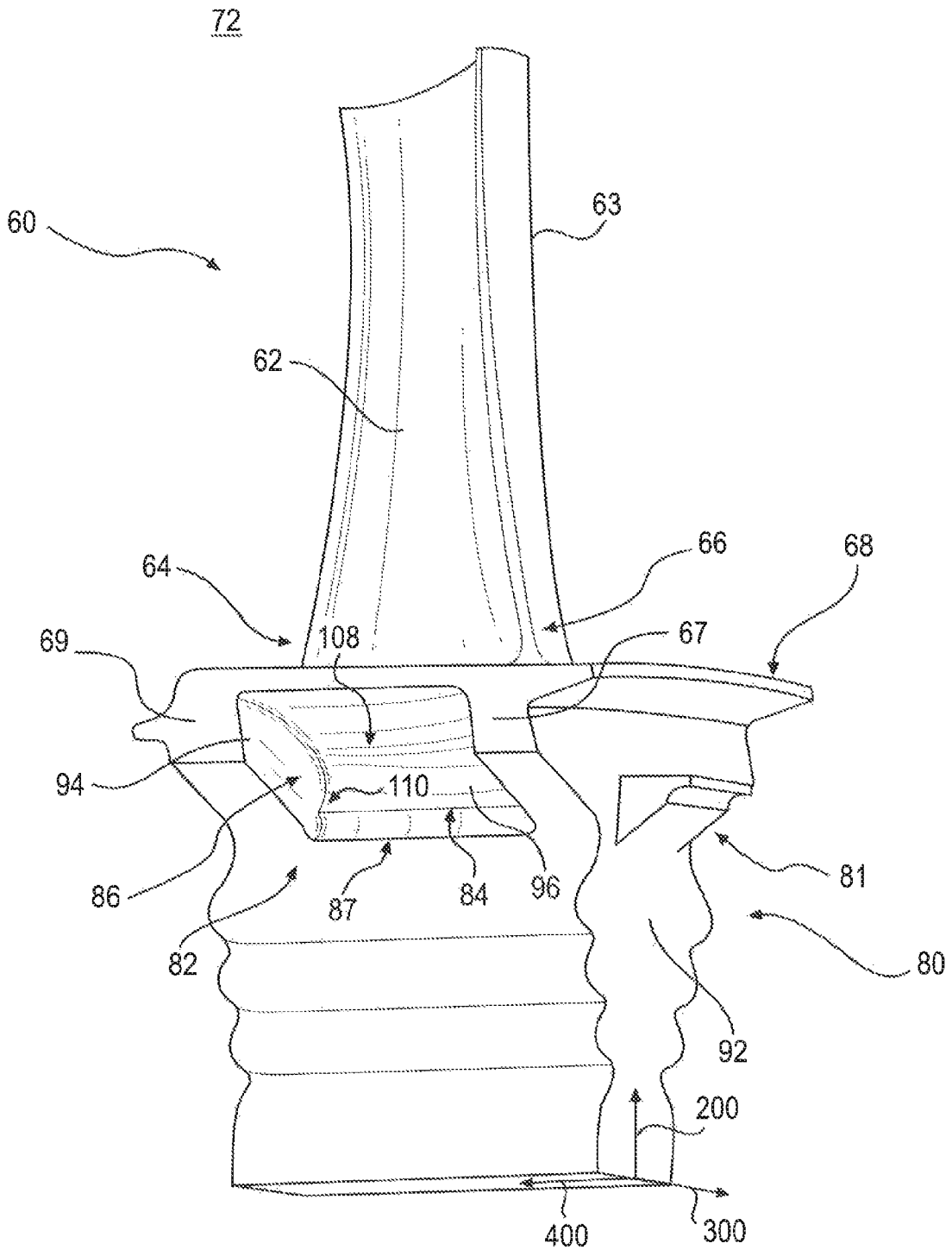
FIG. 2 is a first perspective view of an exemplary turbine blade of the GTE.
Figure 7:
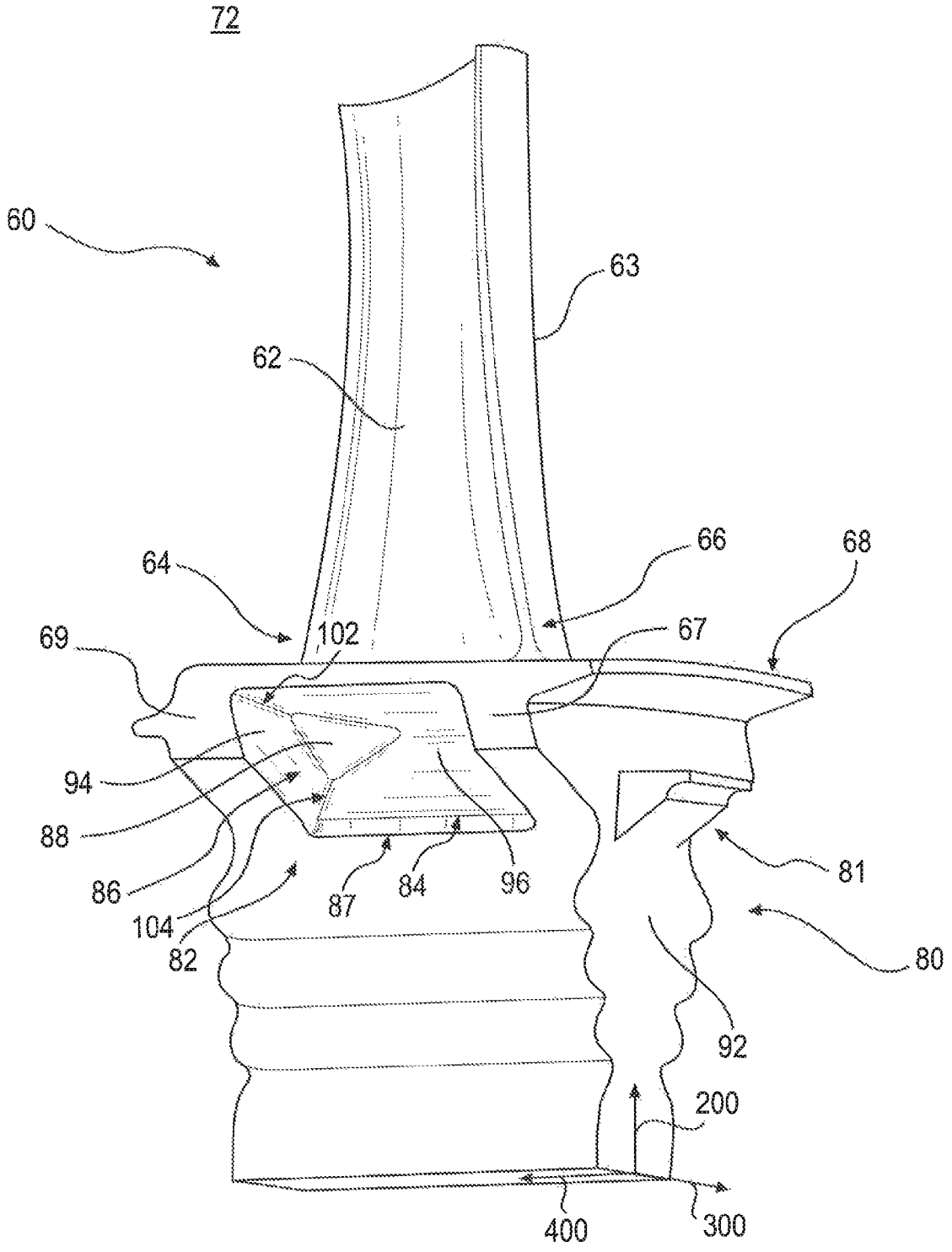
FIG. 7 is a perspective view of another embodiment of a turbine blade of the GTE.

FIG. 2 is a perspective view of an exemplary turbine blade 72 of the GTE 100 shown in FIG. 1. FIG. 2 shows the turbine blade 72 separate from the GTE 100, and indicates a radial direction 200, a circumferential direction 300, and an axial direction 400 for when the turbine blade 72 is in place in the turbine system 70 of the GTE 100. The axial direction 400 may be parallel to the engine axis 98 shown in FIG. 1. FIG. 7 also shows these directions 200, 300, and 400. Although not shown, the directions 200, 300, 400 are also applicable to FIGS. 3 and 4. The turbine blade 72 of FIG. 2 includes an airfoil 60 extending in the radial direction 200 from a turbine blade platform 68. A pressure-side forward buttress 69 and a pressure side aft buttress 67 can be said to extend from or be located below the platform 68. The buttresses 67, 69 can also be referred to as damper arms, support arms, or the like. The turbine blade 72 in FIG. 2, which is oriented to show a pressure side 62, further includes a leading edge 64 and a trailing edge 66. When the turbine blade 72 is disposed in the turbine section 70 of the GTE 100, the leading edge 64 is disposed more upstream of the flow of combustion gases than the trailing edge 66.

The turbine blade 72 further includes a root 80 extending from the platform 68, wherein the root includes a forward wall 91 (FIG. 4) and an aft wall 92 (FIG. 2). In some embodiments, the root 80 may exhibit a shape that can be referred to as a fir-tree shape. In other instances, however, other root shapes may be employed. Furthermore, when the turbine blade 72 is in place in a GTE, a bottom of the root may be flat and oriented along the axial direction 400, as shown in FIG. 2. In some instances (not shown), however, the root 80 may have a structure such that the root 80 is angled to match an angle of a slot of a turbine rotor. This angle, which can be referred to as a "broach angle," can be an angle from the forward wall 91 to the aft wall 92 with respect to an axial direction of the root 80. The axial direction (not shown) may be located along the root 80 perpendicular to both the forward wall 91 and the aft wall 92. In some instances, the broach angle can be between about zero degrees and about twenty-five degrees, for example, twelve degrees. When the root 80 is structured so as to include a broach angle, the turbine blade 72 may be slid into a slot of the turbine rotor in a direction substantially parallel to the engine axis 98, but angled from the forward wall 91 to the aft wall 92 by the broach angle.

Figure 3:
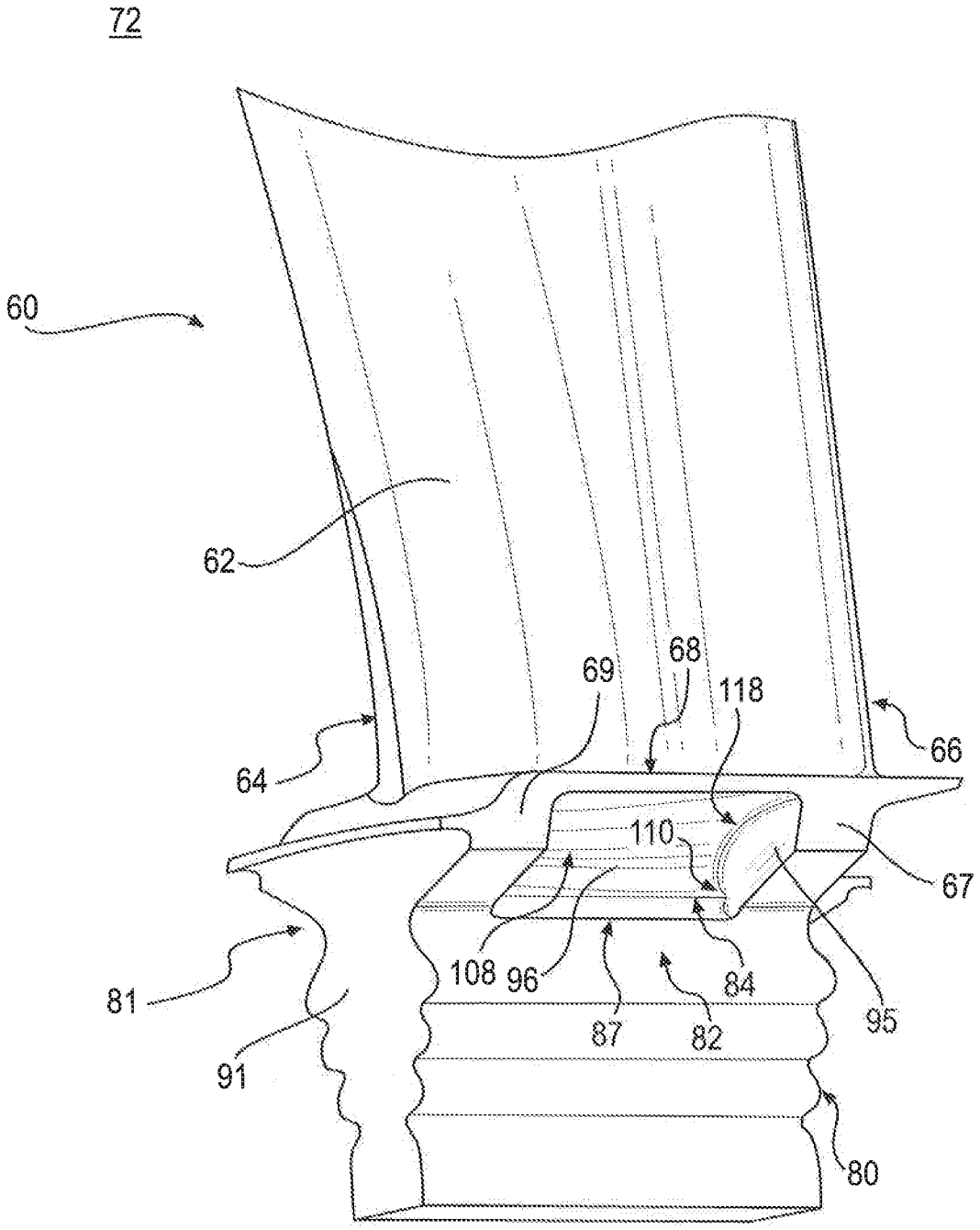
FIG. 3 is a second perspective view of the turbine blade of FIG. 2.
Figure 4:
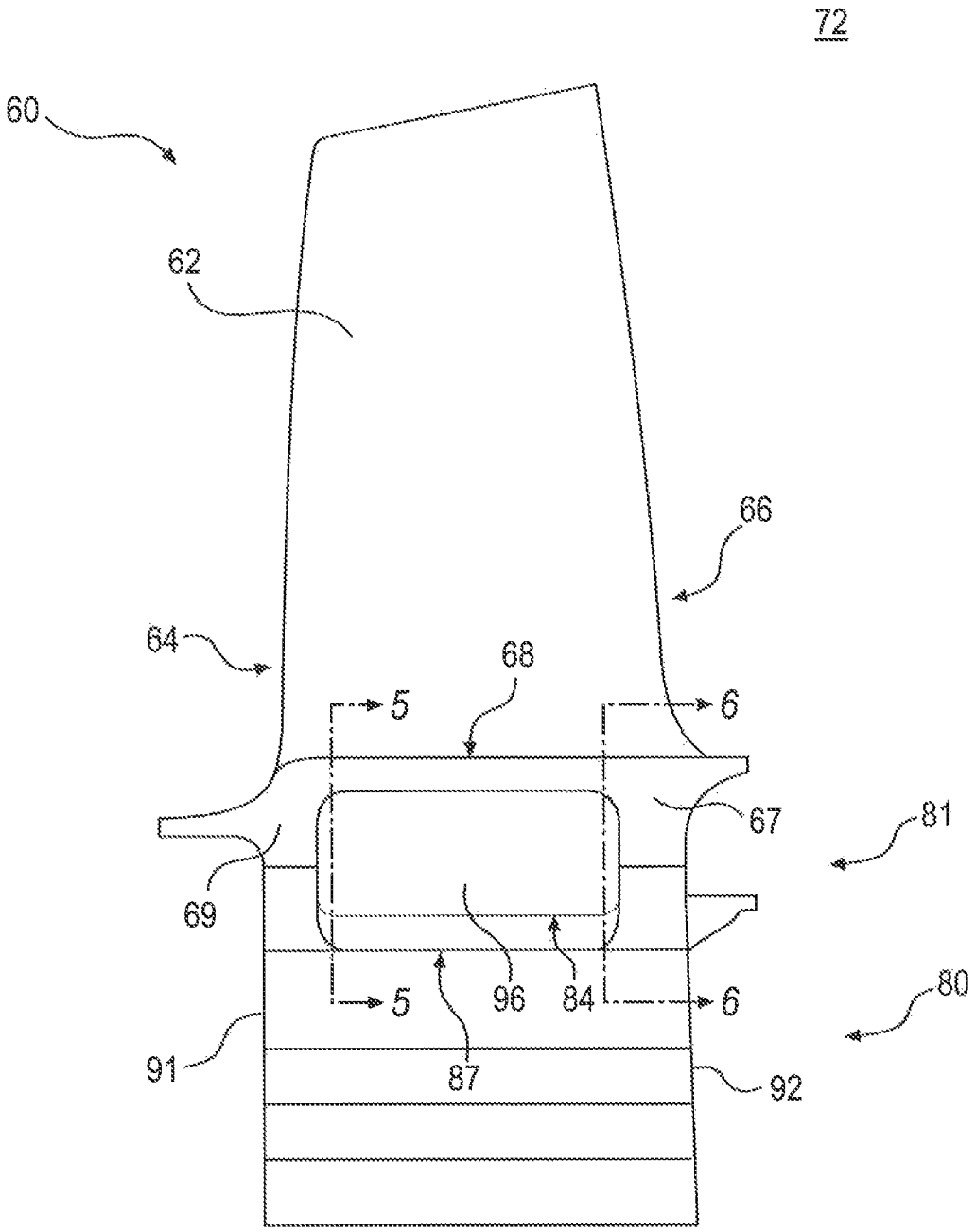
FIG. 4 is a side view of the turbine blade of FIG. 2.

As shown in FIG. 2, the turbine blade 72 includes a pocket 82, referred to herein as a pressure-side pocket. The pressure-side pocket 82 may be formed beneath the platform 68. In some instances, the area in which the pressure-side pocket 82 is formed may be an area between the platform 68 and the root 80, which can be referred to as the neck 81, or the shank, of the turbine blade 72. The pressure-side pocket 82 may be defined by a bottom edge 87, a forward wall 94, an aft wall 95, and a side wall 96 (FIGS. 2-4). The pressure-side pocket 82 may include a width defined as the distance between the forward buttress 69 and the aft buttress 67, or between the forward wall 94 and the aft wall 95. As illustrated in FIG. 2, the pressure-side pocket 82 includes a leading corner 86, which may be located proximate or adjacent to the leading edge 64. The leading corner 86 can be referred to as being radially below the leading edge 64.

The side wall 96 of the pressure-side pocket 82 includes a variable radius fillet 108, also referred to as a first variable radius fillet, located between the root 81 and the platform 68, and between the buttresses 67, 69. The first variable radius fillet 108, described in more detail below, may also be referred to herein as a compound radius fillet, a composite radius fillet, a variable fillet, a compound fillet, a composite fillet, or the like. FIG. 2 shows the first variable radius fillet 108 at and extending from the forward wall 94 of the pressure-side pocket 82. In some instances, the first variable radius fillet 108 may extend the entire width of the pressure-side pocket 82, i.e., from the forward wall 94 to the aft wall 95, and from the forward buttress 69 to the aft buttress 67. The pressure-side pocket 82 may also include a shelf 84 located between the first variable radius fillet 108 and the bottom edge 87. As shown in FIGS. 2 and 3, the shelf 84, which may also be referred to as a step, ledge, or the like, may jut out from the pressure-side pocket 82 towards the ends of the buttresses 67, 69. In some instances, the shelf 84 may extend within the pressure-side pocket 82 the entire distance between the buttresses 67, 69. In other instances, however, the shelf 84 may only extend a portion of the distance between the buttresses 67, 69. In yet other instances, although not shown, the pressure-side pocket 82 may not include a shelf 84, and the first variable radius fillet 108 may extend all the way to the bottom edge 87.

As shown in FIGS. 2 and 3, the pressure side pocket 82 may also include another variable radius fillet 110, also referred to as a second variable radius fillet or an additional variable radius fillet, extending between the forward and aft buttresses 67, 69, respectively. The second variable radius fillet 110, described in more detail below, may be located adjacent to the shelf 84 if a shelf 84 is included. If the turbine blade 72 does not include a shelf 84, the turbine blade 72 may also not include the second variable radius fillet 110, or the second variable radius fillet 110 may be located adjacent to the bottom edge 87 of the pressure-side pocket 82.

FIG. 3 is a second perspective view of the turbine blade 72. Specifically, FIG. 3 shows a different view of the pressure side 62 than that shown in FIG. 2. As shown in FIG. 3, the pressure-side pocket 82 includes a trailing corner 118, which may be located proximate or adjacent to the trailing edge 66. The trailing corner 118 may also be referred to as being positioned below the trailing edge 66. FIG. 3 shows the first variable radius fillet 108 at and extending from the aft wall 95 of the pressure-side pocket 82. As in FIG. 2, the first variable radius fillet 108 may extend to the shelf 84 near the pressure side aft buttress 67. In instances when the turbine blade 72 does not include a shelf 84 adjacent the aft buttress 67 or at all, the first variable radius fillet 108 may extend all the way to the bottom edge 87 adjacent the aft buttress 67.

Figure 6:
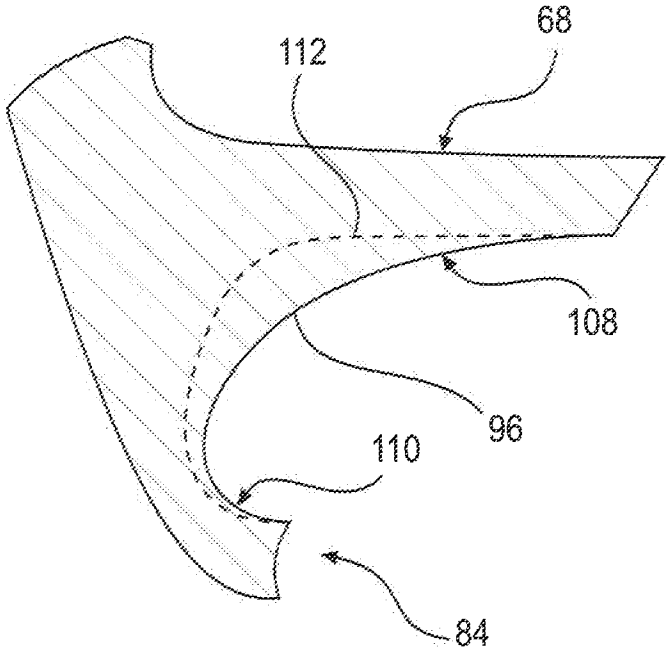
FIG. 6 is a second partial cross-sectional view along the line 6-6 of FIG. 4.
Figure 5:
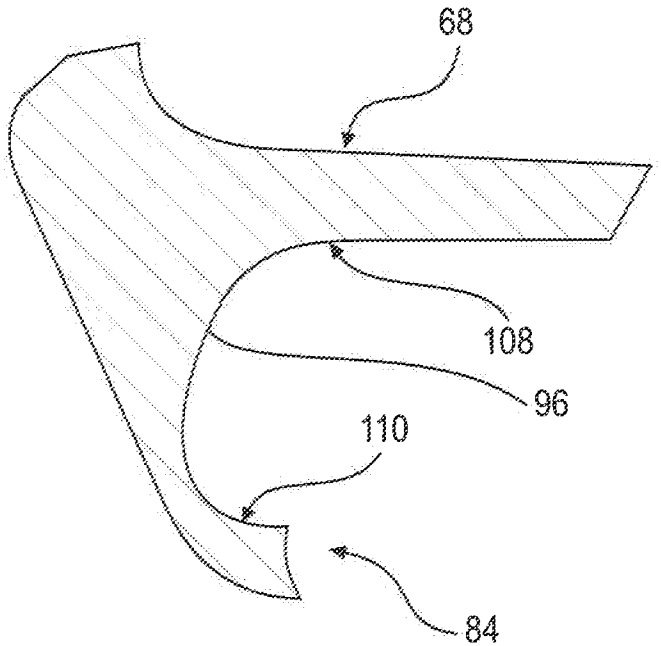
FIG. 5 is a first partial cross-sectional view along the line 5-5 of FIG. 4.

FIG. 4 is a side view showing the pressure side 62 of the turbine blade 72. FIG. 5 is a cross-sectional view along line 5-5 of FIG. 4, and FIG. 6 is a cross-sectional view along line 6-6 of FIG. 4. FIGS. 5 and 6 each show cross-sectional views at different locations of the pressure-side pocket. FIG. 5 shows a cross-sectional view adjacent or proximate to the forward buttress 69, while FIG. 6 shows a cross-sectional view adjacent or proximate to the aft buttress 67. Both FIGS. 5 and 6 show the first variable radius fillet 108, as well as the second variable radius fillet 110, of the side wall 96. The dashed line 112 in FIG. 6 corresponds to the side wall 96 at the cross-section shown in FIG. 5. The dashed line 112 is provided to show the difference between the side wall 96 at the cross-section in FIG. 5 and the side wall 96 at the cross-section in FIG. 6. Specifically, dashed line 112 helps to illustrate the different radii of the first variable radius fillet 108 and the second variable radius fillet 110 at the cross-sections shown in FIGS. 5 and 6.

The radius of the first variable radius fillet 108 may increase from the forward buttress 69 to the aft buttress 67, that is, in an aft direction of the turbine blade 72. Thus, the radius of the first variable radius fillet 108 adjacent the forward buttress 69 as shown in FIG. 5 may be smaller than the radius of the first variable radius fillet 108 adjacent the aft buttress 67 as shown in FIG. 6. Similarly, the radius of the second variable radius fillet 110 may increase in the aft direction such that the radius of the second variable radius fillet 110 adjacent the forward buttress 69 as shown in FIG. 5 may be smaller than the radius of the second variable radius fillet 110 adjacent the aft buttress 67 as shown in FIG. 6. In some instances, to increase the radius of the first variable radius fillet 108 in the aft direction, material forming the first variable radius fillet 108 may be added within the pressure-side pocket 82. Material forming the first variable radius fillet 108 may be added such that the amount of material increases in the aft direction of the turbine blade 72. For example, by comparing FIGS. 5 and 6, there may be more material disposed within the pressure-side pocket 82 to form the first variable radius fillet 108 adjacent to the aft buttress 67 (FIG.

6) than adjacent to the forward buttress 69 (FIG. 5). In some instances, material may be added to the first variable radius fillet 108 such that the first variable radius fillet 108 nearly extends to an edge of the platform 68 at a location where the radius is largest, e.g., adjacent the aft buttress 67. In this instance, it may appear that the first variable radius fillet 108 substantially fills the pressure-side pocket 82, at least in the area adjacent the aft buttress 67.

The radius of the first variable radius fillet 108 adjacent the forward buttress 69 (FIG. 5) may be between about 0.20 and 0.30 inches (5.08 and 7.62 mm), for example, about 0.25 inches (6.35 mm). The radius of the first variable radius fillet 108 adjacent the aft buttress 67 (FIG. 6) may be between about 0.60 and 0.70 inches (15.24 and 17.78 mm), for example, about 0.65 inches (16.51 mm). Thus, the radius of the first variable radius fillet 108 increases in the aft direction of the turbine blade 72. In some instances, the radius of the first variable radius fillet 108 may increase linearly from the forward buttress 69 to the aft buttress 67. Therefore, when the increase is linear, the radius of the first variable radius fillet 108 at a point halfway between the forward buttress 69 and the aft buttress 67 may be equal to double the radius shown in FIG. 5, and equal to half the radius shown in FIG. 6.

In instances where the turbine blade 72 includes a second variable radius fillet 110, the second variable radius fillet 110 may have a radius adjacent the forward buttress 69 (FIG. 5) between about 0.05 and 0.07 inches (1.27 and 1.78 mm), for example, about 0.06 inches (1.52 mm). The radius of the second variable radius fillet 110 adjacent the aft buttress 67 (FIG. 6) may be between about 0.09 and 0.11 inches (2.29 and 2.79 mm), for example, about 0.10 inches (2.54 mm). Thus, the radius of the second variable radius fillet 110 may also increase in the aft direction of the turbine blade 72. In some instances, the radius of the second variable radius fillet 110 may increase linearly from the forward buttress 69 to the aft buttress 67. Therefore, when the increase is linear, the radius of the second variable radius fillet 110 at a point halfway between the forward buttress 69 and the aft buttress 67 may be equal to double the radius shown in FIG. 5, and equal to half the radius shown in FIG. 6. The radii of the second variable radius fillet 110 in the aft direction may therefore differ from the radii of the first variable radius fillet 108 in the aft direction. The above-mentioned values for the various radii of the first and/or second variable radius fillet 108, 110 at specific locations within the pressure-side pocket 82 are exemplary only, as the values of these radii may vary. Additionally, while the radii of the first and second variable radius fillets 108, 110 may increase linearly, and thus gradually, in the aft direction of the turbine blade 72, in some instances one or both of these radii may increase in a non-linear manner.

FIG. 7 is a perspective view of another embodiment of the turbine blade 72 of the GTE 100 shown in FIG. 1. The turbine blade 72 shown in FIG. 7 may be identical to the turbine blade 72 shown in FIGS. 2-6, except that the pressure-side pocket 82 may include a support pad 88 disposed in the leading corner 86. The support pad 88 may be a triangular support pad that protrudes from the leading corner 86. When the support pad 88 is provided, the first variable radius fillet 108 may extend from a corner or side of the pad 88 and from a smaller radius to a larger radius in an aft direction (i.e., from the corner or side of the pad 88 to the aft buttress 67). When the support pad 88 is provided, the pressure-side pocket 82 may also include a forward fillet 102 and a side fillet 104. As shown in FIG. 7, the forward fillet 102 may extend from a corner of the support pad 88 along the forward wall 94 and to an end of the pressure-side forward buttress 69. The side fillet 104 may extend from another corner of the support pad 88 along the forward wall 94 and to the shelf 84. In instances when the turbine blade 72 does not include the shelf 84, the side fillet 104 may extend all the way to the bottom edge 87.

With respect to the turbine blade 72 illustrated in FIGS. 1-7, this turbine blade 72 may be, for example, from the second stage of the GTE 100 shown in FIG. 1. Additionally, although not shown in detail, the turbine blade 72 includes a suction-side 63 (FIGS. 2 and 7) opposite the pressure side 62. The suction side 63 may include a suction-side pocket, which may include a constant radius fillet rather than a variable radius fillet, and which may also not include any support pad or similar structure. In other instances, however, the suction-side pocket may include one or more variable radius fillets and/or a support pad disposed in a corner of the pocket resulting in a suction-side pocket having a similar shape and dimensions to the pressure-side pocket 82.

INDUSTRIAL APPLICABILITY

The above-disclosed apparatus, while being described for use in a GTE, can be used generally in applications or industries involving components subject to high stresses. A variable radius fillet, like that described with respect to the turbine blades described above, may be integrated with a component that may experience high stresses from, for example, centrifugal force.

The GTE 100 produces power by extracting energy from a flow of hot gas produced by combustion of fuel in a stream of compressed fluid, for example air, from the compressor system 10. Energy is released when a mixture of the compressed air and fuel is burned in the combustor system 20. The fuel injectors 30 direct a liquid or gaseous hydrocarbon fuel into the combustor system 20 for combustion. The resulting hot gases are directed through the turbine system 70, past the stages 73, 74, 75, over stator vanes and the turbine blades, to spin the turbine and produce mechanical power. Turbine blades rotating within the turbine system 70, for example, blades 72, may include a variable radius fillet 108 as described with respect to FIGS. 2-6. Additionally or alternatively, one or more of the turbine blades 72 may include a support pad 88 in the pressure-side pocket 82 as described above with respect to FIG. 7.

In one instance, the first variable radius fillet 108, the second variable radius fillet 110, and/or the support pad 88 may be formed integrally during casting of the turbine blade 72, for example, during investment casting. Thus, the material forming the first and/or second variable radius fillet 108, 110 or the support pad 88 may be the same as the material forming the rest of the turbine blade 72. Furthermore, the turbine blade 72 may be cast as a single crystal.

During turbine rotation, the turbine blades may experience high stresses. For example, a given turbine blade may experience high localized stresses beneath the platform at locations on the pressure-side buttresses near the pressure-side pocket. These localized stresses may be a contributing factor in causing the platform, and thus the turbine blade, to fail due to crack formation and propagation. A crack may form at the area of highest stress, for example, at one of the pressure-side buttresses, and propagate upwards towards the platform. As one example, investigation of second-stage turbine blades has shown possible crack initiation and propagation along a pressure side of the root or neck near the leading edge of the blade, and extending upwards from the pressure side forward buttress to the platform. Turbine blade failures may damage a GTE, and cause inconvenient and unscheduled shutdowns to repair and/or replace damaged GTE components.

Preventing, or at least reducing the likelihood of, turbine blade fractures and failures may extend the life of the turbine blades and improve GTE operation. This can be achieved at low cost by employing the apparatus described above. Specifically, the first variable radius fillet may help to lower peak stresses beneath the platform, while balancing the stresses between the pressure side and the suction side of the turbine blade. Providing the additional material beneath the platform on the pressure side of the turbine blade may help to carry some of the load and unload stresses at and under the buttresses, where peak stresses may be located, in order to achieve peak stresses within a desired, operable range. A turbine blade having the first variable radius fillet described herein may also counteract one or both of axial and radial loads applied to the turbine blade during GTE operation. Thus, the first variable radius fillet may help prevent turbine blade failure due to crack initiation and propagation.

In some instances, the first variable fillet radius 108 may help to reduce peak stresses by about 35% or more compared to a stress value measured without the first variable fillet radius 108. For example, without a first variable fillet radius 108 like that described above, peak stresses of about 200 ksi were recorded, at a location on the pressure side forward buttress of a turbine blade. When the blade was manufactured with a first variable radius fillet in the pressure-side pocket, however, a peak stress of about 129 ksi was recorded, located at the pressure side aft buttress. Thus, addition of the above-described first variable radius fillet 108 may help decrease platform stresses by about 35%, thereby enabling a longer turbine blade life. Although not required, adding the second variable fillet radius 110 and/or the support pad 88 may help to further reduce stresses to prolong turbine blade life. Additionally, while peak stresses of about 111 ksi have been recorded on the suction side of the turbine blade and may be satisfactory for GTE operation, a variable radius fillet like the first variable radius fillet located in the pressure-side pocket may be provided in a suction-side pocket to further reduce suction-side peak stresses. In addition to the variable radius fillet, airfoil repositioning, a support pad such as triangular pad 88, and/or other radii changes to the turbine blade 72 may also help to reduce peak stresses.

Adding the pad 88, for example, by integrating the pad 88 with the turbine blade 72 during manufacturing (e.g. investment casting), can improve turbine blade durability and stiffness without adversely affecting GTE performance. The pad 88 can provide additional support to the turbine blade 72, particularly to the platform 68, to reduce the likelihood or altogether prevent the initiation and propagation of cracks. That is, the pad 88 provides a means to combat the high localized stresses applied to the turbine blades 72 during GTE operation. Locating the pad 88 in the leading corner 86 can alter the stress concentration or stress field imparted on the turbine blade 72 during GTE operation. Although leading corner 86 where the pad 88 may be located may not necessarily be the location under the greatest stress, placing the pad 88 in the leading corner 86 can have the effect of unloading the stress on the region under the highest stress. Thus, because a portion of the pressure side forward buttress 69 may be under the highest stress, placing the pad 88 in the leading corner 86 may reduce the stress on the forward buttress 69, which may prevent crack initiation and propagation.

As described above, the pad 88 shown in FIGS. 2 and 3 may have a triangular shape. While locating the pad 88 in the leading corner 86 of the pressure-side pocket 82 may help to reduce localized stresses on the turbine blade 72, proving the pad 88 with a triangular shape can help to ensure these stress reductions. The triangular shape of the pad 88 in the corner 86 may help to alter the stress field to unload the stress on highly stressed areas of the turbine blade 72, such as the pressure side forward buttress 69. Thus, the combination of locating the pad 88 in the leading corner 86 of the pressure-side pocket 82, and providing the pad 88 in a triangular shape, may help prevent turbine blade crack initiation and propagation, which can lead to turbine blade failure.

Each of the embodiments described herein may apply to various stages of the turbine system 70. For example, the variable radius fillet 108 may be incorporated into a pressure-side pocket of a turbine blade in another stage of the turbine system 70, including stages beyond the first, second, and third stages 73, 74, 75 shown in FIG. 1. Additionally, with respect to the support pad 88 shown in FIG. 7, the support pad 88 or similar structure could be positioned at locations other than in the leading corner 86 of the pressure-side pocket 82, for example, elsewhere in the pressure-side pocket 82, in the suction-side pocket 83, or at another location beneath the turbine blade platform 68.

It will be apparent to those skilled in the art that various modifications and variations can be made to the disclosed apparatus and method of turbine blade. Other embodiments will be apparent to those skilled in the art from consideration of the specification and practice of the disclosed system and method. It is intended that the specification and examples be considered as exemplary only, with a true scope being indicated by the following claims and their equivalents.

What is claimed is:

1. A gas turbine engine comprising:

a compressor system configured to compress a flow of air;

a combustor system configured to combust a mixture of the air and a fuel to produce a hot gas flow; and a turbine system configured to use the hot gas flow to produce power, wherein the turbine system comprises:

a plurality of turbine blades comprising:

a platform;

an airfoil extending from one side of the platform;

a neck extending from another side of the platform, wherein the neck includes a forward buttress and an aft buttress axially spaced from the forward buttress;

a root extending from the neck;

a pocket defined by a plurality of walls and located between the forward buttress and the aft buttress; and a variable radius fillet disposed within the pocket and defined between the root and the side of the platform from which the neck extends, the variable radius fillet having a plurality of different radii in radial cross-sections at different axially-spaced locations along the pocket extending between the forward buttress and the aft buttress, wherein a first radius of the plurality of different radii of the variable radius fillet adjacent to the forward buttress is smaller than a second radius of the plurality of different radii of the variable radius fillet adjacent to the aft buttress.

2. The gas turbine engine of claim 1, wherein each turbine blade further comprises a pressure side and a suction side, wherein the pocket is disposed on the pressure side.

3. The gas turbine engine of claim 1, wherein successive radii of the plurality of different radii increase linearly from the forward buttress to the aft buttress.

4. The gas turbine engine of claim 1, wherein the variable radius fillet is integral with the turbine blade.

5. The gas turbine engine of claim 1, wherein the variable radius fillet extends an entire distance between the forward buttress and the aft buttress.

6. The gas turbine engine of claim 1, further comprising a shelf disposed in the pocket and extending between the forward buttress and the aft buttress.

7. The gas turbine engine of claim 1, further comprising an additional variable radius fillet disposed within the pocket and extending between the forward buttress and the aft buttress, wherein a radius of the additional variable radius fillet increases from the forward buttress to the aft buttress.

8. The gas turbine engine of claim 1, wherein an amount of material forming the variable radius fillet is greater adjacent the aft buttress than adjacent the forward buttress.

9. A turbine blade comprising:

a platform;

an airfoil extending from one side of the platform;

a neck extending from another side of the platform, wherein the neck includes a forward buttress and an aft buttress axially spaced from the forward buttress;

a root extending from the neck;

a pocket defined by a plurality of walls and located between the forward buttress and the aft buttress; and a variable radius fillet disposed within the pocket and defined between the root and the side of the platform from which the neck extends, the variable radius fillet having a plurality of different radii in radial cross-sections at different axially-spaced locations along the pocket extending between the forward buttress and the aft buttress, wherein a first radius of the plurality of different radii of the variable radius fillet adjacent to the forward buttress is smaller than a second radius of the plurality of different radii of the variable radius fillet adjacent to the aft buttress.

10. The turbine blade of claim 9, wherein the pocket is positioned on a pressure side of the turbine blade.

11. The turbine blade of claim 9, wherein successive radii of the plurality of different radii increase linearly from the forward buttress to the aft buttress.

12. The turbine blade of claim 9, wherein the first radius adjacent the forward buttress is about 0.25 inches and the second radius adjacent the aft buttress is about 0.65 inches.

13. The turbine blade of claim 9, wherein the variable radius fillet extends an entire distance between the forward buttress and the aft buttress.

14. The turbine blade of claim 9, further comprising a shelf disposed in the pocket and extending between the forward buttress and the aft buttress.

15. The turbine blade of claim 14, wherein the shelf is disposed between the variable radius fillet and the root.

16. The turbine blade of claim 9, further comprising an additional variable radius fillet disposed within the pocket and extending between the forward buttress and the aft buttress, wherein a radius of the additional variable radius fillet increases from the forward buttress to the aft buttress.

17. A gas turbine engine employing the turbine blade of claim 9.

18. A turbine blade comprising:

a platform;

an airfoil extending from one side of the platform;

a neck extending from another side of the platform, wherein the neck includes a forward buttress and an aft buttress;

a root extending from the neck;

a pocket defined by a plurality of walls and located between the forward buttress and the aft buttress; and a variable radius fillet disposed within the pocket and defined between the root and the side of the platform from which the neck extends, the variable radius fillet having a plurality of different radii in radial cross-sections at different axially-spaced locations along the pocket, wherein the variable radius fillet extends between the forward buttress and the aft buttress, and wherein an amount of material forming the variable radius fillet is greater adjacent the aft buttress than adjacent the forward buttress.

19. The turbine blade of claim 18, wherein the variable radius fillet extends an entire width of the pocket.

20. A gas turbine engine employing the turbine blade of claim 18.

* * * * *